US009291329B2

(12) United States Patent
Dubuc

(10) Patent No.: US 9,291,329 B2
(45) Date of Patent: Mar. 22, 2016

(54) TRAFFIC SIGNAL HAVING A UNIFORM LIGHT SURFACE

(75) Inventor: Eden Dubuc, St. Michel (CA)

(73) Assignee: GE LIGHTING SOLUTIONS, LLC, Cleveland, OH (US)

( * ) Notice: Subject to any disclaimer, the term of this patent is extended or adjusted under 35 U.S.C. 154(b) by 1827 days.

(21) Appl. No.: 11/794,397

(22) PCT Filed: Oct. 25, 2005

(86) PCT No.: PCT/US2005/038466

§ 371 (c)(1), (2), (4) Date: Sep. 8, 2008

(87) PCT Pub. No.: WO2006/073539

PCT Pub. Date: Jul. 13, 2006

(65) Prior Publication Data

US 2009/0103325 A1 Apr. 23, 2009

Related U.S. Application Data

(60) Provisional application No. 60/640,421, filed on Dec. 30, 2004, provisional application No. 60/682,578, filed on May 19, 2005.

(51) Int. Cl.

| | |
|---|---|
| ***F21V 8/00*** | (2006.01) |
| ***F21V 5/04*** | (2006.01) |
| ***F21V 7/00*** | (2006.01) |
| ***G09F 9/33*** | (2006.01) |
| *F21W 111/02* | (2006.01) |
| *F21Y 101/02* | (2006.01) |

(52) U.S. Cl.

CPC ..... *F21V 5/04* (2013.01); *F21V 7/0091* (2013.01); *G09F 9/33* (2013.01); *F21W 2111/02* (2013.01); *F21Y 2101/02* (2013.01)

(58) Field of Classification Search

USPC ..... 362/362, 800, 545, 546, 543, 544, 812; 40/547, 556, 557, 606.1

See application file for complete search history.

(56) References Cited

U.S. PATENT DOCUMENTS

| | | | |
|---|---|---|---|
| 2,215,900 | A | 9/1940 | Bitner |
| 3,629,655 | A | 12/1971 | Fullmer |
| 4,914,435 | A | 4/1990 | Gould et al. |
| 5,416,679 | A | 5/1995 | Ruskouski et al. |
| 5,528,474 | A | 6/1996 | Roney et al. |

(Continued)

FOREIGN PATENT DOCUMENTS

| | | |
|---|---|---|
| EP | 1 091 167 | 4/2001 |
| GB | 319 661 | 10/1930 |

(Continued)

OTHER PUBLICATIONS

European Search Report for PCT/US2005/038466.

*Primary Examiner* — Sharon Payne
(74) *Attorney, Agent, or Firm* — Fay Sharpe LLP

(57) ABSTRACT

A LED signal (2) having has an element that facilitates providing a uniform distribution of light is illustrated. The LED signal (2) includes a housing (4) and a cover (6) operatively attached the housing (4). At least one LED (12) resides on at least one circuit board (14), which is affixed to the housing (4) opposite the cover (6). An optic (18) resides adjacent to the at least one LED (12) and redirects light rays emitted by the LED (12) to provide a uniform distribution of light through the cover (6).

19 Claims, 6 Drawing Sheets

(56) References Cited

U.S. PATENT DOCUMENTS

| | | | | |
|---|---|---|---|---|
| 6,184,628 | B1 | 2/2001 | Ruthenberg | |
| 6,402,347 | B1 | 6/2002 | Maas et al. | |
| 6,819,505 | B1 * | 11/2004 | Cassarly et al. | 359/726 |
| 2002/0149494 | A1 | 10/2002 | Martineau | |
| 2004/0165380 | A1 | 8/2004 | Chew | |
| 2004/0252520 | A1 | 12/2004 | Martineau | |

FOREIGN PATENT DOCUMENTS

| | | |
|---|---|---|
| WO | WO 2004/001459 | 12/2003 |
| WO | WO 96/24802 | 8/2006 |

* cited by examiner

TRAFFIC SIGNAL HAVING A UNIFORM LIGHT SURFACE

CROSS-REFERENCE TO RELATED PATENTS AND APPLICATIONS

This application claims the benefit of U.S. Provisional Patent Application Ser. No. 60/640,421 filed on Dec. 30, 2004 and entitled "Uniform Look Traffic Signal" and U.S. Provisional Patent Application Ser. No. 60/682,578 filed on May 19, 2005 and entitled "Uniform Look Traffic Signal," the entireties of which are incorporated herein reference.

BACKGROUND OF THE INVENTION

1. Field of the Invention

The present invention generally relates to light signals and, more particularly, to Light Emitting Diode (LED) traffic signals having optics that have uniform light intensity over an emitted surface.

2. Description of Related Art

Light Emitting Diode (LED) signals such as LED traffic signals, pedestrian walk-way signals, arrow signals, alphanumeric signals, etc. present numerous advantages over incandescent lamp signals. For instance, a LED consumes relatively less power and is associated with relatively longer life than an incandescent light source. The longer life typically leads to improved reliability and lower maintenance costs.

Conventional LED signals typically use multiple LEDs in an array to replicate the light output of the incandescent lamp. For example, a sufficient number of LEDs are incorporated into the signal to create and fill the shape of the symbol (e.g., a hand, a man-walking, etc.) displayed by the signal. However, such conventional signals usually do not create a uniform light surface. As a consequence, one or more of the LEDs, or the individual points of light from each LED, are discernable within the light surface. Such signals are often referred to as "dotted signals" and can create a display aspect that is visually displeasing. If one or more LED burns out, a void may be left in the appearance of the signal. Further, if the LEDs are not closely matched in intensity and color the resultant appearance may be non-homogenous.

Each generation of LEDs typically is brighter. As a result, fewer LEDs are needed within a traffic signal in order to provide a relatively similar light appearance. Using fewer LEDs can reduce the cost of the signal. However, using fewer LEDs can also increase the potential for viewing the LEDs as individual point sources and for creating undesirable shadows in non-illuminate areas.

SUMMARY OF THE INVENTION

In one aspect of the invention, a LED signal having has an element that facilitates providing a uniform distribution of light is illustrated. The LED signal includes a housing and a cover operatively attached the housing. At least one LED resides on at least one circuit board, which is affixed to the housing opposite the cover. An optic resides adjacent to the at least one LED and re-directs light rays emitted by the LED to provide a uniform distribution of light through the cover.

BRIEF DESCRIPTION OF THE FIGURES

The drawings are only for purposes of illustrating embodiments and are not to be construed as limiting the claims.

DETAILED DESCRIPTION OF THE INVENTION

Figure 1:
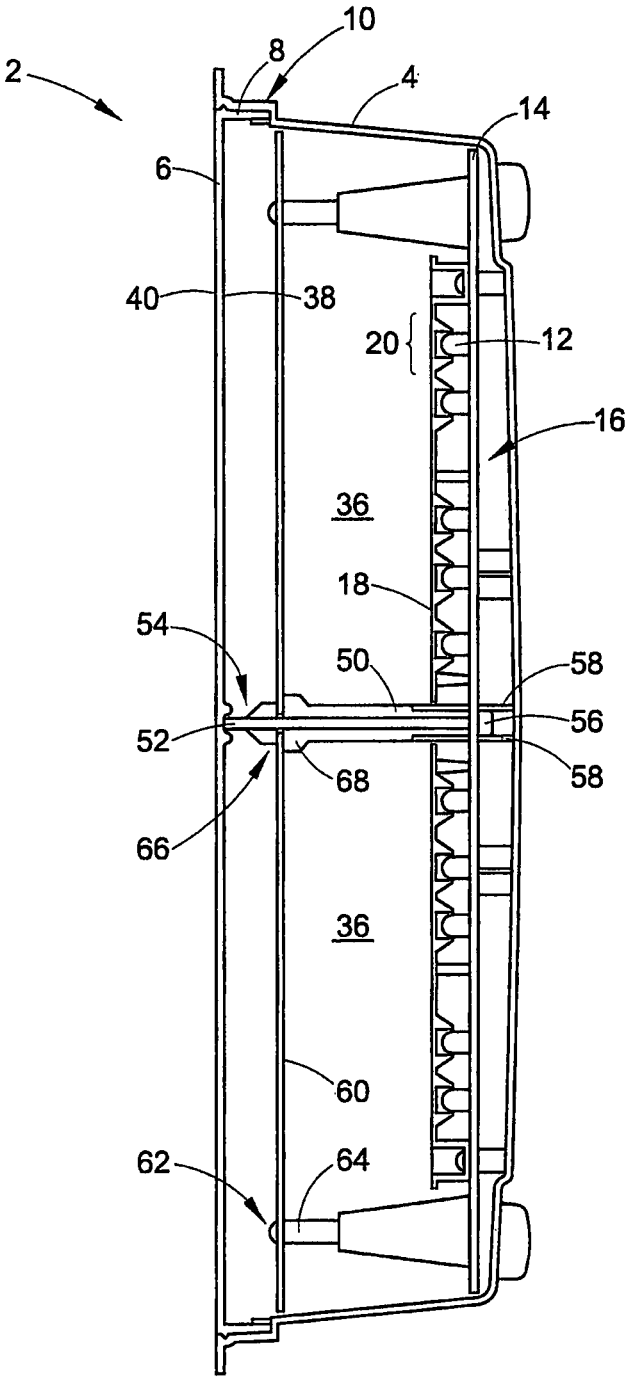
FIG. 1 illustrates an exemplary Light Emitting Diode (LED) signal with an optic that facilitates generating a uniform distribution of light.

FIG. 1 illustrates a Light Emitting Diode (LED) signal 2 (e.g., a hand, a man-walking, an arrow, etc.) having an element that facilitates providing a uniform distribution of light. Conventional LED signals typically do not generate a uniform light surface, and, as a consequence, one or more LEDs of the conventional light signals, or the individual points of light therefrom, may be discernable within the light surface, which results in a visually displeasing appearance. The uniform light distribution provided by the LED signal 2 mitigates such visually displeasing appearances as well as other deficiencies of conventional light signals such as non-lit areas due to non-operative LEDs and/or reducing the number of LEDs.

The LED signal 2 includes a housing 4 operatively connected to a cover 6. Various mechanisms can be used to connect the housing 4 and the cover 6 together. For instance, one or more of a snap, a screw, a rivet, an adhesive, a set screw, a bolt, tape, wire, and the like can be used to connect the housing 4 with the cover 6. As depicted, a portion 8 of the cover 6 may rest within a region 10 of the housing 4. The contact between the portion 8 and the region 10 may additionally and/or alternatively facilitate the connection. A seal (not shown) and/or the like can be used mitigate egress of matter (e.g., contaminants such as water, dust, etc.) into the housing 4 at the point of contact between the housing 4 and the cover 6. Such sealant (e.g., an O-ring, silicon, etc.) may create a hermetic, or airtight, seal that is impervious to virtually any environmental substance.

The LED signal 2 further includes one or more LEDs 12 that reside on a circuited board 14. The LEDs 12 are coupled to the circuit board 14 via through-hole (e.g., soldered and wire wrapped) and/or surface mount (e.g., short pins, flat contacts, matrix of balls (BGAs), etc.) technology. Essentially any number of LEDs 12 can be coupled to the circuit board 14, which can be a single circuit board and/or multiple circuit boards coupled together. In addition, one or more of the LEDs 12 can be associated with a similar and/or different color. An optional lens (not shown) can be placed over each LED 12 to change the light pattern so that different LEDs from different manufacturers can be used without adversely affecting the signal and/or so that light patterns can be changed based on the application.

The circuit board 14 can be a metal core or other type of printed circuit board, or PCB, and typically is positioned proximate a rear portion 16 of the housing 4 such that the LEDs 12 emit light energy through the cover 6. It is to be appreciated that the circuit board can be a metal core or other type of printed circuit board, or PCB. In one embodiment, the circuit board 14 is a Flame Resistant 4 (FR4) printed circuit board with a 5 mm LED, and the electrical current drive power supply resides on the FR4 printed circuit board. Various techniques can be used to attach the circuit board 14 to the rear portion 16. For example, the circuit board 14 can be attached through one or more rivets, screws, adhesives, snaps, tape, wires, other circuit boards, etc. Alternatively, the circuit board 14 can be integrated within the rear portion 16 of the housing 4. The circuit board 14 may alternatively sit within a predefined position on the rear portion 16 and be held in place through various other components within the housing 4. For instance, the circuit board 14 may be held in place by one or more mounting brackets, heat sinks, a control module, a power supply, etc. As depicted, the circuit board 14 resides exclusively within the housing 4. However, it is to be appreciated that at least a portion of the circuit board can reside external to the housing 4 in various other embodiments.

Figure 2:
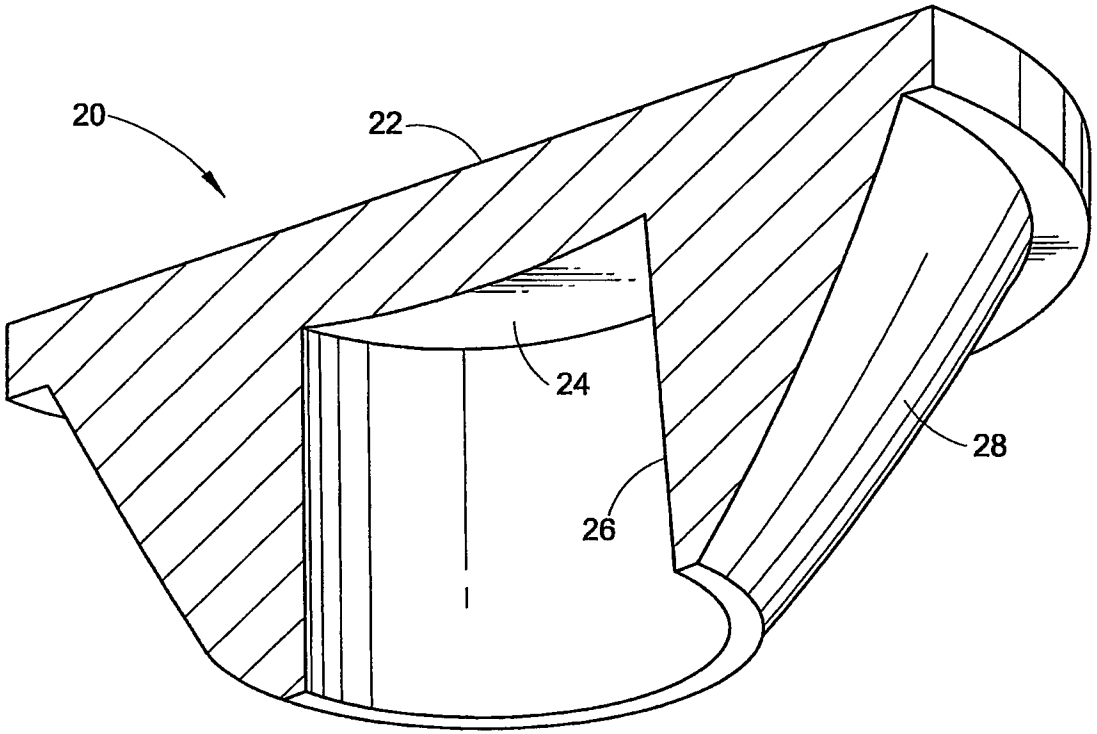
FIG. 2 illustrates an exemplary light pipe for re-directing light emitted from a LED of a LED signal.

An optic 18 collects and/or collimates light energy emitted by the LEDs 12 in order to provide a uniform light distribution from the LEDs 12. In one instance, the optic 18 is formed based on refraction and/or total internal reflection principles. As such, the optic 18 may include a plurality of uniform distribution light pipes 20. Each of the light pipes 20 can form a one-to-one, a one-to-many, or a many-to-one correspondence with the LEDs 12. As illustrated in FIG. 2, each of the light pipes 20 can include one or more refractive surfaces 22, 24, and 26 and/or at least one reflective surface 28 (e.g., a total internal reflective (TIR) surface). In one instance, substantially all of the light emitted from a top portion (not shown) of LEDs 12 is directed by the refractive surfaces 22 and/or the refractive surface 24, and/or substantially all of the light emitted from side portions (not shown) of the LEDs 12 is controlled by the refractive surface 24, the refractive surface 26, and/or the reflective surface 28. The surfaces 22-28 can each be independently suitably angled such that light emitted by the LEDs 12 is uniformly directed from the LEDs 12 to the cover 6. The foregoing provides for a reduction in a number of LEDs used to light the signal 2 while maintaining a substantially uniform light appearance.

Figure 3:
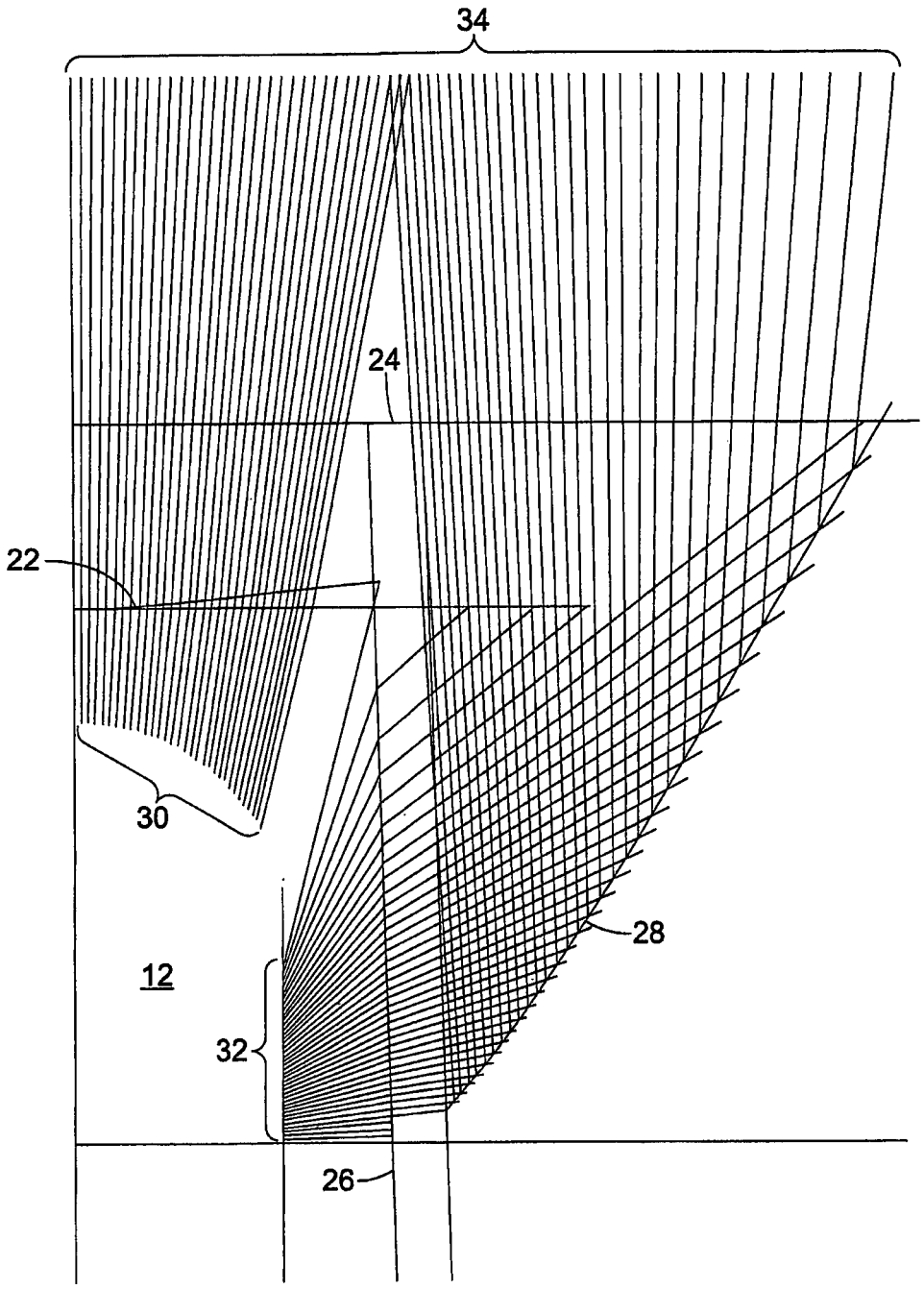
FIG. 3 illustrates an exemplary light tracing of rays of light re-directed by a light pipe.
Figure 4:
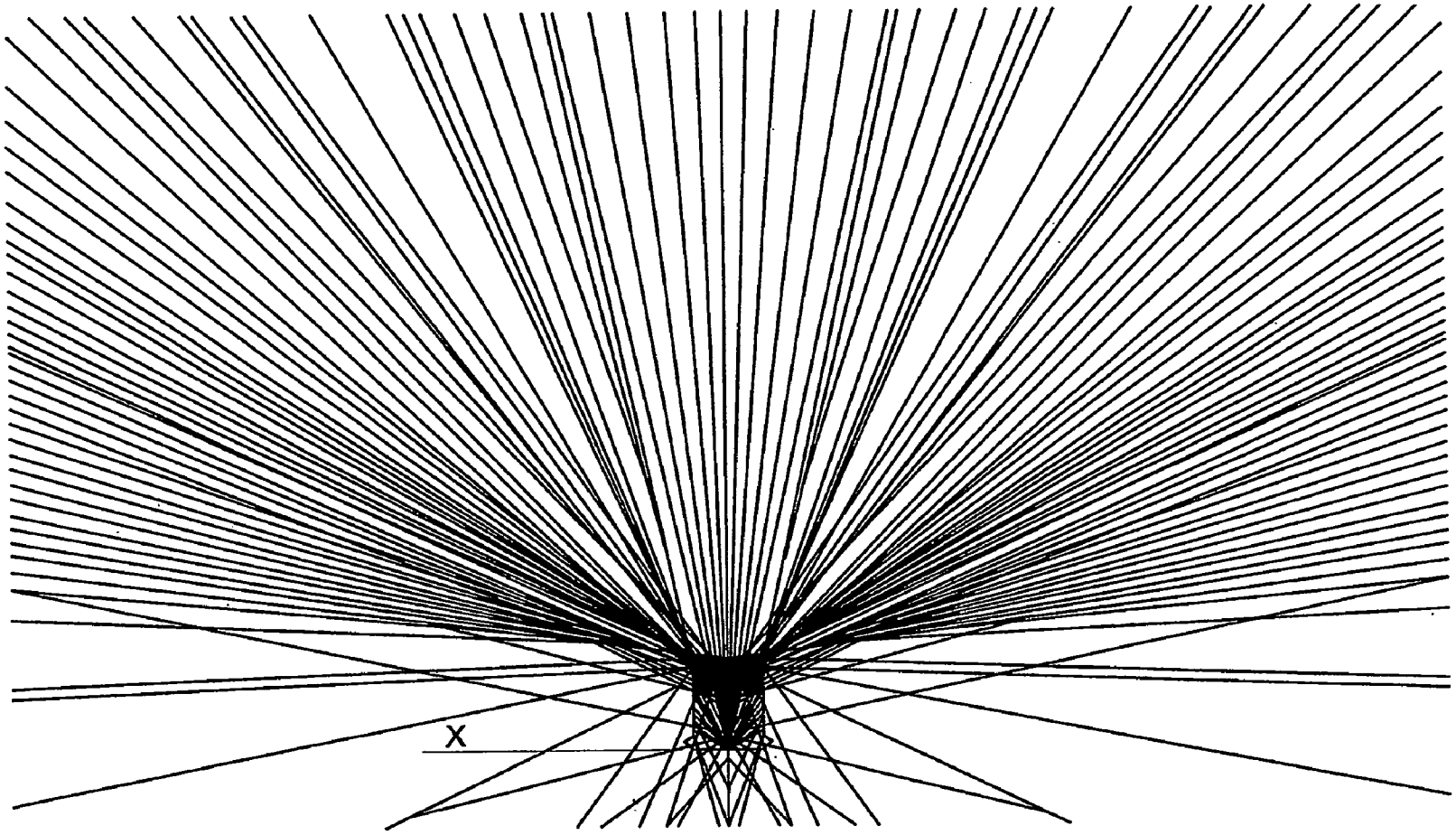
FIG. 4 (Prior Art)
FIG. 4 illustrates an exemplary a non-uniform light distribution from a conventional light signal.
Figure 5:
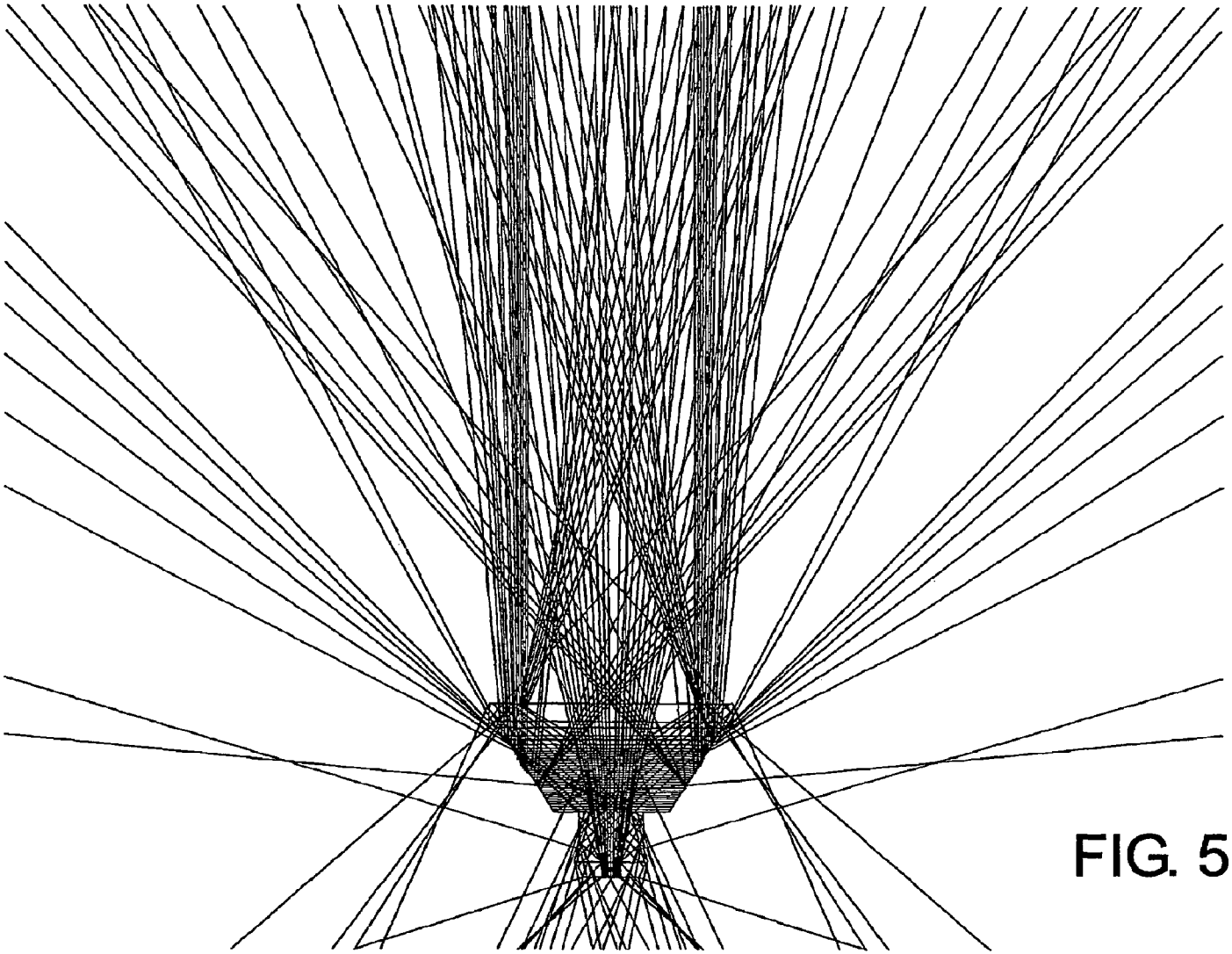
FIG. 5 illustrates an exemplary uniform light distribution from a LED of the LED signal.

FIG. 3 illustrates one non-limiting example of a plurality of light rays originating from one of the LEDs 12 and directed by the surfaces 22-28 of one of the light pipes 20. As depicted, light rays 30 from the LED 12 are re-directed by the refractive surfaces 22 and/or the refractive surface 24, and light rays 32 from the LED 12 are re-directed by the refractive surface 24, the refractive surface 26, and/or the reflective surface 28. The resulting rays 34 are substantially uniform and directed towards the cover 6. FIG. 5 illustrates another example showing uniform light distribution of the LED 12 by the light 20 of the optic 18. The illustrated uniform light distribution can be contrasted with the non-uniform light distribution illustrated in FIG. 4 from a conventional system that does not employ the optic 18 with the light pipes 20.

Returning to FIG. 1, typically it is desirable to illuminate a particular area of the cover 6, for example, substantially an entire area adjacent to compartments 36. In order to facilitate such coverage, the cover 6 is positioned at a suitable distance from the LEDs 12 to allow maximum illumination of the cover 6 with a minimum, or preferably no light lost by illuminating areas other than the cover 6. In order to mitigate spreading the light beyond the desired optical area, an optional lens can be positioned over the LEDs 12 to adjust the light pattern accordingly.

The cover 6 can include a spreading or diffusing portion that distributes light emitted from the LEDs 12 and shaped by the optic 18 through its various surfaces 22-28. The spreading portion can reside on a surface 38 of the cover 6 facing into the housing 4 and/or a surface 40 of the cover 6 opposing the housing 4. In one instance, the surfaces 38 and/or 40 can be frosted and/or irregularly shaped (e.g., curved) to reduce a phantom effect due to the sun and/or direct reflection of the sun's rays. In addition and/or alternatively, the surfaces 38 and/or 40 can include a controlled texture that suitably distributes the light (e.g., according to a particular specification).

Figure 6:
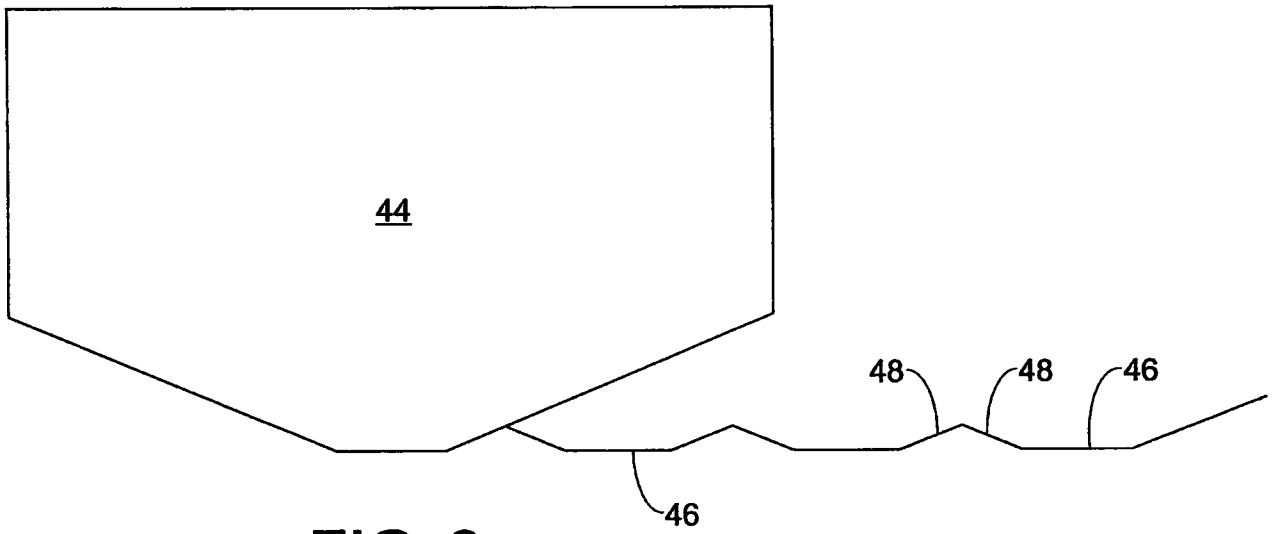
FIG. 6 illustrates an exemplary tool for machining a surface of a spreading window of a LED signal.

Essentially any suitable manufacturing technique can be used to create the cover 6. FIG. 6 illustrates one exemplary manufacturing technique in which a tool 44 is used to machine the spreading portion of the cover 6 with a plurality of flat surfaces 46 and a plurality of angled surfaces 48. In one non-limiting instance, the flat surfaces 46 are machined with the tool 44 to about 0.07 inches in diameter. The flat surfaces 46 are separated by pairs of the plurality of angled surfaces 48, which forms a spacing between the adjacent and/or neighboring flat surfaces 46. In one non-limiting instance, the spacing is about 0.15 inches from center-to-center of neighboring flat surfaces 46. In another non-limiting instance and as depicted, the angled surfaces 48 typically are angled with respect to the panels 46. In one non-limiting instance, this angle is at about 22.525 degrees.

Returning to FIG. 1, one or more baffles 50 can be used to divide a volume of the housing 4 into the one or more distinct compartments 36. Each of the compartments 36 can be used as a separate signal (e.g., one for a "do not walk" symbol and one for a "walk" symbol) and/or two or more of the compartments 36 can be used in conjunction to form a single signal. The baffles 50 and/or other components (not shown) facilitate preventing light within one of the compartments 36 from entering into other compartments 36. The foregoing mitigates a signal associated with one or more of the compartments 36 and in an "off" or non-lit state from appearing to be in an "on," "semi-on," lit, or semi-lit state due to a signal associated with neighboring a compartment 36 in an "on" or lit state.

A first end 52 of the one or more baffles 50 can be supported by the cover 6 through one or more slots 54 formed in the cover 6 and/or be integrally formed within the cover 6. A second end 56 of the one or more baffles 50 can be supported by the housing 4 through one or more guides 58, which may be stationary or slideable.

An optional mask 60 can be used to define a symbol such as a hand, a person walking, etc. The mask 60 typically resides within the housing 4 and may be attached thereto via a connector and/or at least one of the baffles 50. As depicted, a first end 62 of the mask 60 is held in place via a pin 64, and a second end 66 of the mask 60 is held in place via a mask guide 68 of the baffle 50. In other embodiments, only one of these connections, additional connections, or alternative connections are used to attach the mask 60 within the signal 2. For instance, the first end 62 can alternatively be secured to the housing 4 through of a snap, a screw, a rivet, an adhesive, a set screw, a bolt, tape, wire, etc.

An optional separate optic (not shown) residing proximate the cover 6 and opposite the housing 4 can be utilized as a neutral cover. This optic can be clear, tinted, and/or colored, and/or include a smooth and/or textured surface. Additionally and/or alternatively, this optic can provide filtering, protection from the environment, and/or other features. The optional separate optic can be used to connect the cover 6 to the housing 4 and/or seal the signal 2 in order to protect the cover 6, the volume within the housing 4, and/or any components therein from the environment.

It is to be appreciated that the signal 2 can be adapted to retrofit into an existing light fixture and/or incorporated into a new light fixture. To allow an easy retrofit without requiring significant changes to a preexisting AC power distribution and/or logic circuits, the LED signal 2 assemblies can incorporate a power supply (not shown) to drive the LEDs at a lower, controlled, direct current power level.

The invention has been described with reference to the various embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A LED signal comprising:

a housing;

a cover operatively attached to said housing;

at least one circuit board affixed to said housing opposite said cover;

at least one LED arranged on said circuit board;

and an optic residing adjacent to said at least one LED, said optic including a light pipe having a plurality of surfaces that re-directs light rays emitted by said LED along an optical axis to provide a uniform distribution of light through said cover, wherein said plurality of surfaces includes at least one refractive surface and at least one reflective surface and said re-directed light rays do not intersect the optical axis within the light pipe.

2. The LED signal of claim 1, wherein said at least one refractive surface directs light emitted from said LED.

3. The LED signal of claim 1, wherein a plurality of said refractive surfaces directs light emitted from said LED.

4. The LED signal of claim 1, wherein said at least one reflective surface directs light emitted from said LED.

5. The LED signal of claim 1, wherein said cover includes a spreading portion to spread said uniformly distributed light.

6. The LED signal of claim 5, wherein said spreading portion resides on one of a surface of said cover facing said housing and a surface of said cover opposing said housing.

7. The LED signal of claim 1, wherein said cover is at least one of frosted, smooth, irregularly shaped, and textured.

8. The LED signal of claim 1, wherein said optic is positioned for a 1:1 correspondence with the at least one LED.

9. The LED signal of claim 1, further including a seal that mitigates egress of contaminates into said housing.

10. The LED signal of claim 1, wherein said cover includes a plurality of panels.

11. The LED signal of claim 10, wherein said flat surfaces are separated by a plurality of angled surfaces, each positioned at an angle of about 22.525 degrees with respect to the flat surfaces, and wherein said plurality of angled surfaces forms a spacing of about 0.15 inches between centers of neighboring flat surfaces.

12. The LED signal of claim 10, further including a mask within the housing that defines a symbol to illuminate.

13. The LED signal of claim 1, further including one or more baffles that divide a volume of said housing into one or more distinct compartments each of which is used as a distinct signal.

14. The LED signal of claim 1, wherein said one or more baffles prevents light within one of said compartments from entering into other of said compartments.

15. An LED signal comprising:

a housing;

a spreading element operatively attached to said housing;

at least one circuit board affixed to said housing opposite said spreading element;

at least one LED arranged on said circuit board;

an optic residing adjacent to said at least one LED, said optic including a plurality of surfaces, each of which re-directs light rays emitted by said LED along an optical axis to provide a uniform distribution of light through said spreading element, wherein said plurality of surfaces includes at least one refractive surface and at least on reflective surface and said re-directed light rays do not intersect the optical axis within the optic; and a neutral cover residing adjacent to said spreading element, said neutral cover protects said spreading element from the environment and/or connects said spreading element to said housing.

16. The LED signal of claim 1, wherein substantially all of the light rays emitted from a top portion of said at least one LED is directed by the at least one refractive surface and substantially all of the light rays emitted from side portions of said at least one LED is directed by the at least one reflective surface.

17. The LED signal of claim 15, wherein all of the light rays emitted from a top portion of said at least one LED is directed by the at least one refractive surface and all of the light rays emitted from side portions of said at least one LED is directed by the at least one reflective surface.

18. An LED signal comprising:

a housing;

a cover operatively attached to said housing;

a circuit board affixed to said housing opposite said cover;

a LED arranged on said circuit board; and an optic residing adjacent to said LED, said optic directing light emitted by said LED along an optical axis and including:

a plurality of refractive surfaces that directs light emitted from said LED; and at least one reflective surface that directs light emitted from said LED;

said surfaces direct said light substantially parallel to said optical axis within the optic and provide a uniform distribution of light through said cover.

19. The LED signal of claim 18, wherein substantially all of the light rays emitted from a top portion of said at least one LED is directed by the plurality of refractive surfaces and substantially all of the light rays emitted from side portions of said at least one LED is directed by the at least one reflective surface.

* * * * *